United States Patent [19]

Legille et al.

[11] Patent Number: 4,688,773

[45] Date of Patent: Aug. 25, 1987

[54] APPARATUS FOR LAYING A REFRACTORY LINING ON THE INNER WALL OF A VESSEL

[75] Inventors: Edouard Legille; Corneille Melan, both of Luxembourg, Luxembourg

[73] Assignee: Paul Wurth S.A., Luxembourg, Luxembourg

[21] Appl. No.: 847,954

[22] Filed: Apr. 3, 1986

[30] Foreign Application Priority Data

Apr. 3, 1985 [LU] Luxembourg ..... 85836

[51] Int. Cl.[4] ..... C21C 5/44

[52] U.S. Cl. ..... 266/281

[58] Field of Search ..... 266/281, 44, 287; 264/30; 52/749, 187

[56] References Cited

U.S. PATENT DOCUMENTS

| | | | |
|---|---|---|---|
| 4,061,319 | 12/1977 | Tanaka et al. | 266/281 |
| 4,303,363 | 12/1981 | Cervin | 266/281 |

FOREIGN PATENT DOCUMENTS

| | | | |
|---|---|---|---|
| 1154131 | 9/1963 | Fed. Rep. of Germany | 266/281 |
| 3123582 | 11/1982 | Fed. Rep. of Germany | 266/281 |
| 4010402 | 3/1974 | Japan | 266/281 |
| 0197641 | 12/1972 | U.S.S.R. | 266/281 |
| 0403746 | 3/1974 | U.S.S.R. | 266/281 |

OTHER PUBLICATIONS

Tver et al, *Robotics Sourcebook and Dictionary,* 12/83, pp. v, 114 and 115.

Benoit et al, *Les Robots Strategie Industrielle,* 12/82, pp. 8, 9 and 22.

*Primary Examiner*—L. Dewayne Rutledge

*Assistant Examiner*—S. Kastler

*Attorney, Agent, or Firm*—Fishman & Dionne

[57] ABSTRACT

An apparatus for automatically laying the refractory lining along the inner wall of a vessel (i.e., a metallurgical converter) which permits automatic repair of the vessel lining. This refractory brick laying apparatus comprises an operational center capable of being lowered and raised inside the vessel and comprising a lower table, an upper table and a rotary cage arranged between the upper table and the lower table and connected to each of these by a runway block. The upper table or lower table has a sufficiently large orifice to allow a pallet of refractory bricks to pass inside the rotary cage. Arranged on the rotary cage is a robot which has at least three degrees of freedom, such that it can reach all points of the working range. The end of the robot is equipped with a gripping device for automatically picking up, handling and laying the bricks intended for forming the refractory lining.

11 Claims, 2 Drawing Figures

APPARATUS FOR LAYING A REFRACTORY LINING ON THE INNER WALL OF A VESSEL

BACKGROUND OF THE INVENTION

The present invention relates to an apparatus for laying a refractory lining on the inner wall of a vessel. More particularly, this invention relates to a bricklaying apparatus comprising an operational center capable of being lowered and raised within a vessel. Although not being limited thereto in its utility, this invention is especially well suited in the repair of the inner refractory lining of a metallurgical converter.

It is known that the repair of the refractory lining of a converter is repetitive work which must be carried out frequently, (i.e., at least once every three weeks for each converter). Moreover, this work has to be performed under extremely difficult conditions (inside the vessel and in a dust-laden atmosphere). It is also very exhausting work, because the bricks can weigh up to several tens of kilos.

Consequently, attempts have been made to mechanize and, if possible, automate at least some of this work; in particular the transportation and handling of the bricks. For example, a type of hoist with an endless chain is used for this bricklaying purpose. This prior art apparatus transports the bricks individually from a manual depalletizing station located outside the converter towards a platform which is arranged inside the converter and on which there are several workers occupied with lining the wall with bricks.

There are also prior art systems which involve lifting an entire column of bricks and laying it on a new brick at the rate at which the bricks are removed above it by the workers on the platform.

However, the various prior systems described hereinabove have several disadvantages. First, there is a lack of flexibility when the platform is supplied with bricks. In fact, it is not possible for the workers to select individual bricks since the bricks arrive one by one. When a worker requires a brick of a particular size at a certain moment (even though that brick can be specifically ordered) before receiving it, the worker must nevertheless receive those bricks already engaged in the hoist. Moreover, because of the depalletization, the reception and the laying of the bricks are all carried out by hand; and manual labor is still required for the actual brick-lining.

SUMMARY OF THE INVENTION

The above-discussed and other problems of the prior art are overcome or alleviated by the brick-laying apparatus of the present invention. In accordance with the present invention, an apparatus for laying a refractory lining on the inner wall of a vessel is provided which is completely automatic and which has great flexibility with regard to individual handling of the bricks. The present invention includes an operational center comprising a lower table, locking means or wedging the lower table between the walls of the vessel, an upper table, a rotary cage arranged between the upper table and the lower table and connected to each of these by means of a runway block. The upper or lower table have a sufficiently large orifice to allow a pallet of refractory bricks to pass inside the rotary cage. The present invention further includes at least one robot which is mounted on the rotary cage and has at least three degrees of freedom, so that it can reach all points of the working range. The end of the robot is equipped with a gripping device for automatically picking up, handling and laying the bricks intended for forming the refractory lining.

The robot preferably comprises a first arm mounted on a column and moveable about and along a first vertical axis, and a second arm mounted at the end of the first arm by means of a joint with a second vertical axis of rotation, the gripping device being mounted on the end of the second arm by means of a joint with a third vertical axis of rotation.

The above discussed and other features and advantages of the present invention will be apparent and understood to those skilled in the art from the following detailed description and drawings.

BRIEF DESCRIPTION OF THE DRAWINGS

Referring now to the drawings, wherein like elements are numbered alike in the several Figures.

Figure 1:
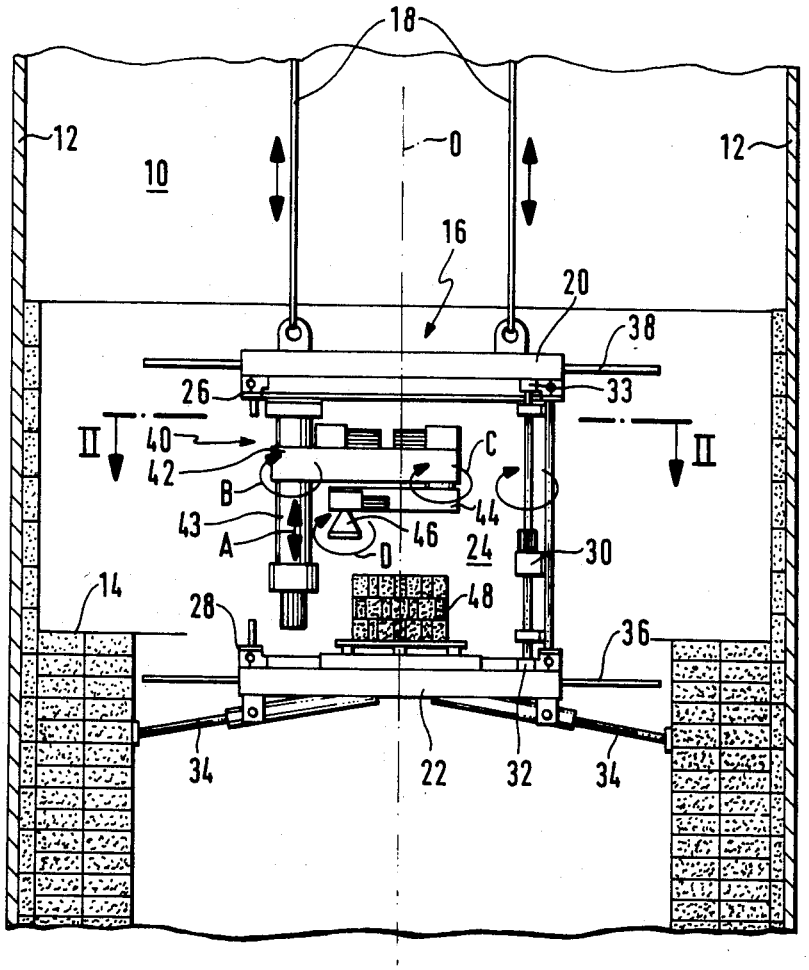
FIG. 1 is a diagrammatic side view, partly in cross section of the bricklaying apparatus of the present invention positioned inside a vessel.

DESCRIPTION OF THE PREFERRED EMBODIMENT:

FIG. 1 illustrates a portion of a metallurgical converter 10 comprising a metal wall 12 which is substantially cylindrical, at least in its central portion, and an inner refractory lining 14 comprised of a stack of refractory bricks laid on top of one another. It will be appreciated that this lining 14 has to be repaired regularly (on average approximately once every two weeks or three weeks).

To achieve automatic handling and laying of the bricks, the present invention includes a platform 16 which, in the illustrated example, is suspended, by means of cables 18, from a winch or travelling bridge (not shown) which is located outside converter 10 such that platform 16 can be retained or lowered within converter 10. It will be appreciated that other means of moving platform 16 may be provided; for example telescopic arms, a crane, a cage with several elements, etc.

Also, rather than suspending the operational center from the upper opening of the vessel, it may be secured to the end of a cage of variable length; or to a telescopic mast resting on the bottom of the vessel; or on the ground if there is an orifice in the bottom.

Platform 16 comprises an upper table 20 and a lower table 22, between which is located a rotary cage 24 which can rotate about the axis O (in relation to stationary tables 20 and 22). The rotary connection between cage 24 and each of tables 20 and 22, is effected by means of an upper annular runway block 26 and a lower annular runway block 28. An electric motor 30, for example a stepping motor, mounted on cage 24 actuates a pinion 32 which engages with a toothed ring provided on the portion of runway block 26 which is integral with table 22. Consequently, during operation, motor 30 urges cage 24 to rotate about the axis O. To immobilize table 20 during this rotation, a pinion 33 connected rigidly to pinion 32 engages with a toothed ring provided on the portion of the runway block 26 which is integral with table 20. To prevent platform 16 from swaying, table 22 is equipped with several extendable props 34, for example pneumatic jacks which are adapted to bear on the refractory lining 14 which was previously laid.

The surface area of lower table 22 is preferably variable, so that the apparatus can be adapted for use in converters of variable or different diameters. For this purpose, table 22 can have a peripheral girdle 36 consisting of several radially displaceable or removable sections. However, girdle 36 must be sufficiently stable to be capable of supporting at least one person needed for directing the operations. The upper table is preferably also provided with a similar girdle 38 which functions as a protective shield for the person standing on the lower girdle.

An important and critical component of the apparatus of the present invention is a robot 40 mounted on rotary cage 24 and fastened either to the ceiling or to the floor of the latter. In the illustrated example, robot 40 is fastened to the ceiling of cage 24 and has four degrees of freedom symbolized by the arrows A, B, C, and D. Robot 40 comprises a bracket consisting of a first arm 42 which can slide vertically on a column 43 according to the arrow A and rotate horizontally about column 43 according to the arrow B, and a second arm 44 which is mounted at the end of the first arm 42 which can rotate relative to the latter about a vertical axis in the direction of arrow C. Located at the free end of the second arm 44 is a gripping device 46 which can also rotate about a vertical axis in the direction of the arrow D. Gripping device 46 can be designed in the form of a suction cup which can grasp and carry the bricks by means of pneumatic suction. Gripping device 46 can also be configured in the form of a tool with claws for picking up the bricks on their sides. The rotary movement B can also be replaced by a rectilinear movement. It will be appreciated that the vertical movement A may also be executed at the end of arm 44.

Robot 40 is also provided, in a well known manner, with sensors (not shown) which make it possible to detect the position of the gripping device 46 and monitor and control its actions. It is also equiped with data-processing means necessary for completely automatic, independent and preprogrammed operation. As mentioned, such sensors and data processing means are all well known to those skilled in the art and so no further description thereof is necessary.

When lining a converter with bricks, platform 16 is lowered into converter 10 by unwinding the carrying cables 18. This lowering operation can be controlled and monitored for example, by a person standing on lower table 22.

After the platform has been locked at the desired height by means of props 34, one or more pallets of bricks 48 and 50 (see FIG. 2) are lowered by means of a winch through an orifice, provided for this purpose in the upper table 20, as far as the floor of the moveable cage 24. The operation is usually conducted with two pallets loaded with bricks of different conicities, so that brick-lining can be carried out according to the actual shape of the body of the vessel.

Figure 2:
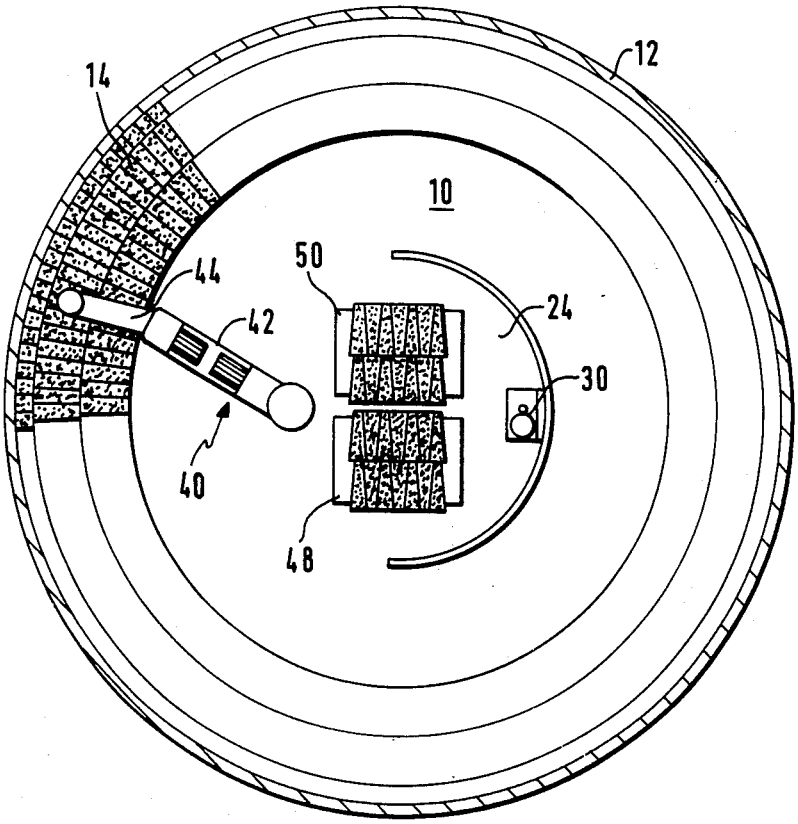
FIG. 2 is a diagrammatic view along the horizontal sectional plane II—II of FIG. 1.

During the brick-lining operation, robot 40, as a result of its degree of freedom, is moved continuously between a brick pick-up position corresponding substantially to the position of FIG. 1 and a position corresponding to that of FIG. 2, in which the bricks are laid on the lining 14. The bricks can be picked up and laid either individually or several may be picked up and laid at the same time.

Since robot 40 operates fully automatically, the person (i.e., operator) who is on the platform will have very little manual work to perform. The operator's main job will be to observe and check the quality of the bricks; control the vertical movement of the platform 16; and, if appropriate, lay the last brick of a row.

It will be appreciated that motor 30 is controlled automatically by robot 40 in order to rotate the moveable cage 24.

Alternatively several robots may be provided to increase the speed at which the vessel is lined with bricks. These robots can work in parallel. In other words, each robot can work independently, or in series so as to complement one another; in which case each robot carries out some of the work of the single robot illustrated in the Figures.

The robots normally work fully automatically according to a predetermined program. However, the robots are preferably designed in such a way that, if required, they can be controlled manually and individually from a control panel.

It must be stressed that the robot 40 illustrated in the Figures is only an exemplary embodiment. For example, it is possible to provide (rather than the pivoting moveable arm 42), a carriage which is displaceable in the radial direction. The pivoting arm 44 would then be mounted on this carriage by means of a pivot with a vertical axis of rotation. The gripping device 46 mounted on the end of arm 44 would then have to allow the gripping tool to rotate about a vertical axis with this tool moving vertically along this axis.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for laying a refractory lining on the inner wall of a vessel comprising:

an operational center capable of being lowered and raised inside the vessel along the vessel axis, said operational center comprising;

a non-rotating lower table;

locking means for wedging said lower table between the walls of the vessel;

a non-rotating upper table;

rotary cage means positioned between said upper table and said lower table and connected therebetween;

means for rotating said cage means about said vessel axis in relation to said upper and lower tables;

said upper table or said lower table having a sufficiently large orifice to allow a pallet of refractory bricks to pass inside said rotary cage means; and at least one robot having sensing and data processing capabilities and which is mounted on the rotary cage, said robot being pivotable about at least three axes whereby said robot can reach all points of the working area, said robot including an end which is equipped with a gripping device for automatically picking up, handling and laying the bricks intended for forming the refractory lining.

2. The apparatus of claim 1 wherein said robot comprises:

a first arm mounted on a column and moveable about and along a first vertical axis of rotation; and a second arm mounted at the end of said first arm by means of a joint with a second vertical axis of rotation, said gripping device being mounted on the end of said second arm by means of a joint with a third vertical axis of rotation.

3. The apparatus of claim 1 wherein said means for rotating said rotary cage means includes:

an electric motor.

4. The apparatus of claim 1 wherein:

said locking means comprises extendable props.

5. The apparatus of claim 1 wherein:

said lower table has a peripheral girdle of variable area, said girdle comprising several removable or radially displaceable sections.

6. The apparatus of claim 1 wherein said upper table includes a protective shield.

7. The apparatus of claim 1 wherein a plurality of robots are provided on the rotary cage.

8. The apparatus of claim 7 wherein said robots work in parallel.

9. The apparatus of claim 7 wherein said robots work in series.

10. The apparatus of claim 7 wherein:

each robot is adapted to be controlled manually and individually.

11. The apparatus of claim 1 wherein:

said rotary cage means is connected between said upper and lower tables by runway block means.

* * * * *